United States Patent [19]

Nelson et al.

[11] 4,095,393

[45] Jun. 20, 1978

[54] BAG FORMING AND FILLING MACHINE

[76] Inventors: Craig R. Nelson, 711 Shunpike Rd., Green Village, N.J. 07935; Roy A. Nelson, deceased, late of Green Village, N.J.; by Elizabeth D. Nelson, administratrix, 711 Shunpike Rd., Green Village, N.J. 07935

[21] Appl. No.: 770,194

[22] Filed: Feb. 18, 1977

[51] Int. Cl.[2] ..... B65B 5/02; B65B 9/10; B65B 43/30

[52] U.S. Cl. ..... 53/183; 53/262; 53/286

[58] Field of Search ..... 53/182, 183, 187, 255, 53/258, 261, 262, 384, 386, 29

[56] References Cited

U.S. PATENT DOCUMENTS

| | | | |
|---|---|---|---|
| 2,653,429 | 9/1953 | Fitzgerald | 53/183 X |
| 2,770,933 | 11/1956 | Hakomaki et al. | 53/29 |
| 2,982,068 | 5/1961 | Pape et al. | 53/29 X |
| 3,557,526 | 1/1971 | Hartmann | 53/183 |
| 3,874,976 | 4/1975 | MacFarland | 53/182 R |

*Primary Examiner*—Robert Louis Spruill
*Attorney, Agent, or Firm*—Blair, Brown & Kreten

[57] ABSTRACT

A bag forming and filling apparatus in which a continuous tube of heat sealable plastic is fed from a roll along a pathway where it is cut to the desired length and sealed on one end. The opposite end of the sealed tubing engages over an expandable hollow mandrel which expands the open end of the tube to permit material to be inserted therein. The filled section of tubing is then fed in reverse along the same path to a point of storage or use.

6 Claims, 15 Drawing Figures

20
85
8
156
174
11
169
13
171
10
170
129
128
130
132
133
82
158
137
135
146
137
164
14
B
R'
136
138
140
139
65
134
52
53
6
6
13
10
142
8
123
148
64
11
147
141
25
63
26
3
38
4
42
48
62
60
36
47
50
21
49
31
3
24
24
37
43
38
58
44
45
59
59
41
4
23
21
22
22

FIG. 14.
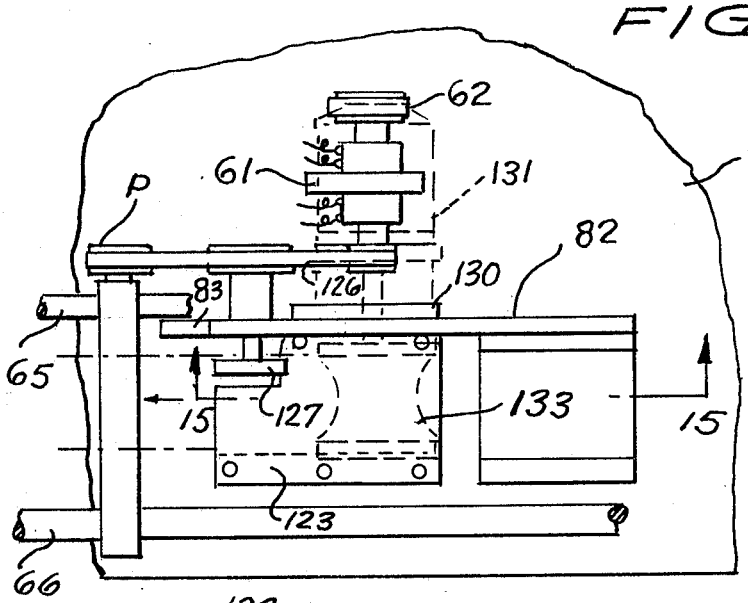
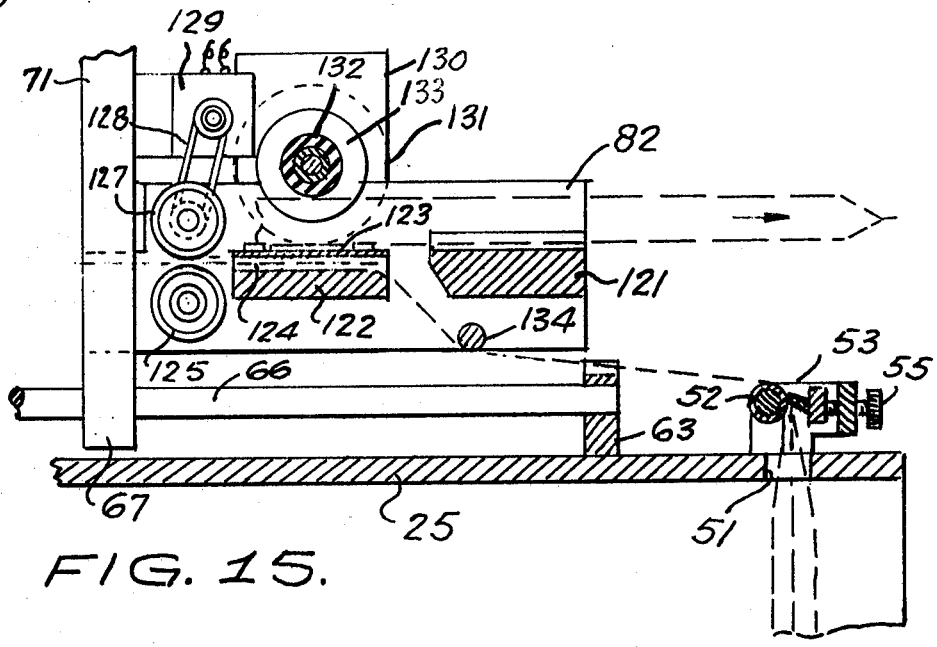
FIG. 15.

BAG FORMING AND FILLING MACHINE

BACKGROUND OF THE INVENTION

1. FIELD OF THE INVENTION

The present invention relates to the forming and filling of bags in the same apparatus.

2. SUMMARY OF THE INVENTION

In the present apparatus a roll of heat sealable plastic tubing is fed through the apparatus and along its path where it is severed and sealed at one end. The tubing now a bag is fed onto a hollow expandable mandrel which opens the bag to receive the contents. The filled bag is then fed in reverse along the same path for packing and shipment.

The primary object of the invention is to provide an apparatus for forming a bag and filling the bag after it is formed.

Other objects and advantages will become apparent in the following specification when considered in light of the attached drawings.

BRIEF DESCRIPTION OF THE DRAWINGS

FIG. 14 is a fragmentary top plan view taken on the line 14—14 of FIG. 2 looking in the direction of the arrows; and FIG. 15 is a fragmentary sectional view taken on the line 15—15 of FIG. 14 looking in the direction of the arrows.

DESCRIPTION OF THE PREFERRED EMBODIMENT

Figure 1:
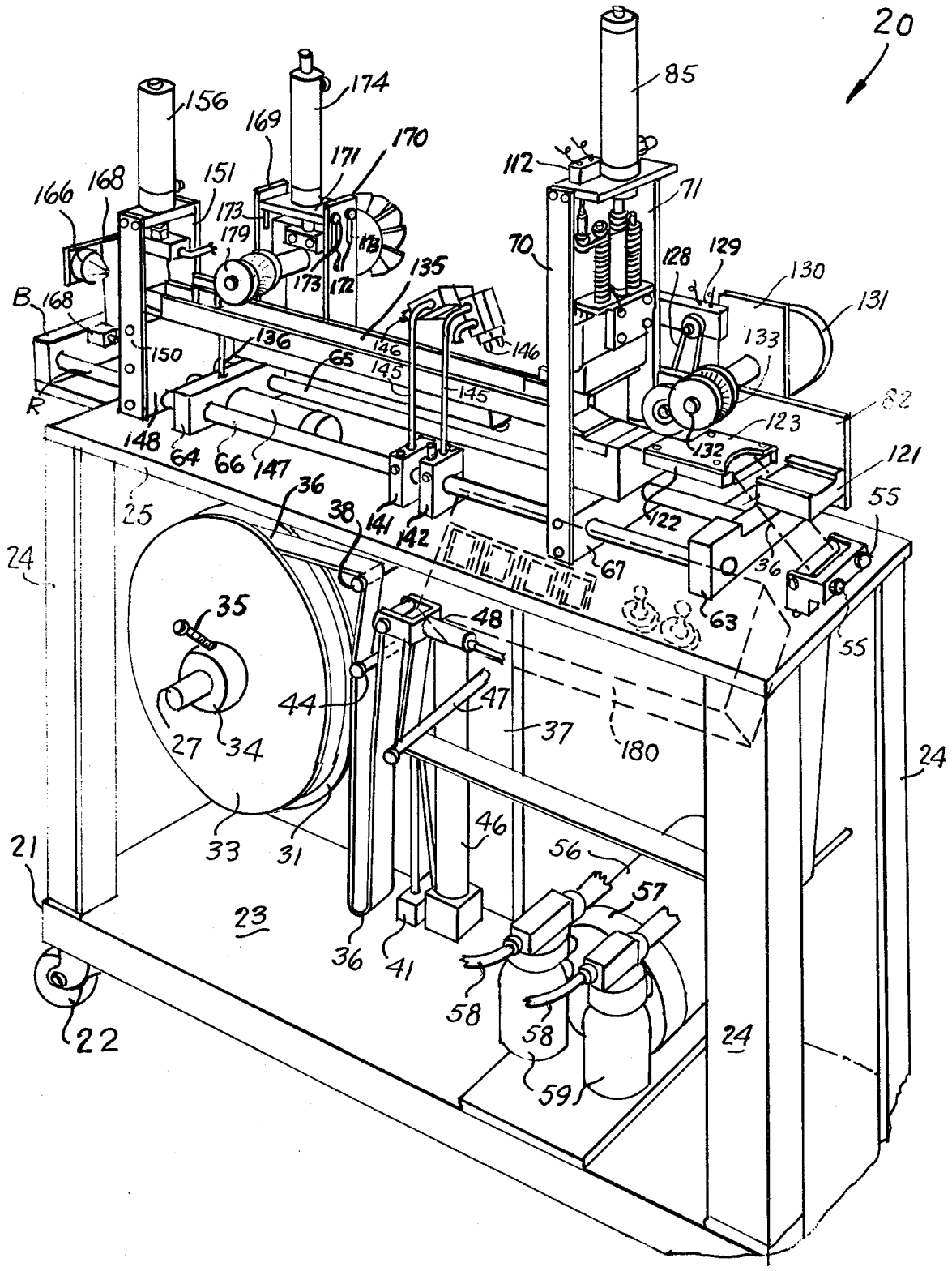
FIG. 1 is a perspective view of the invention.
Figure 2:
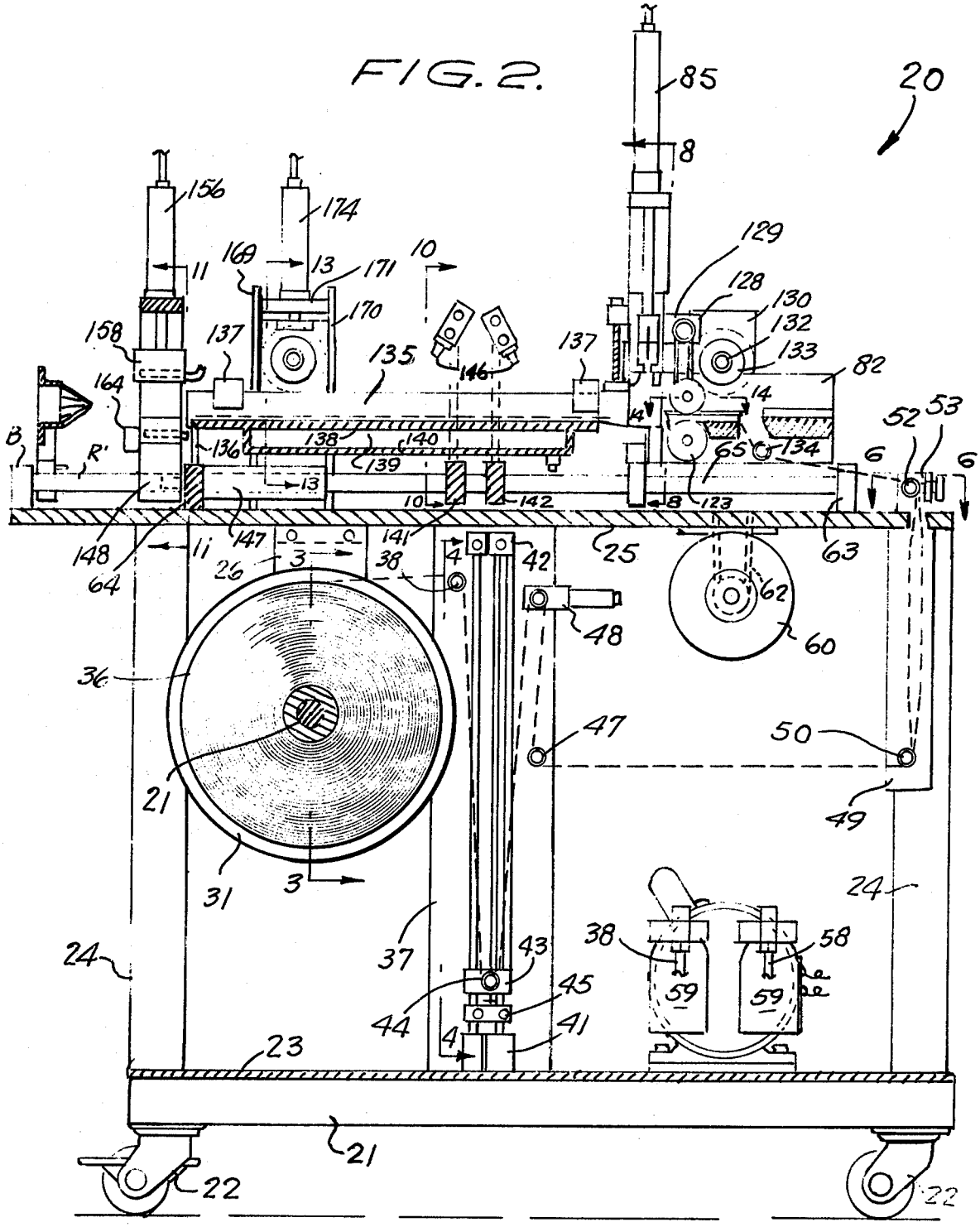
FIG. 2 is a vertical sectional view taken on the line 2—2 of FIG. 1 looking in the direction of the arrows.
Figure 3:
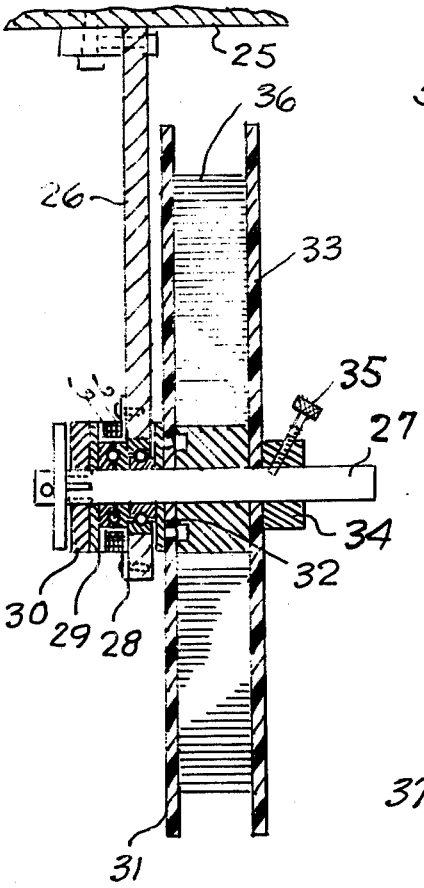
FIG. 3 is an enlarged fragmentary vertical sectional view taken on the line 3—3 of FIG. 2 looking in the direction of the arrows.
Figure 4:
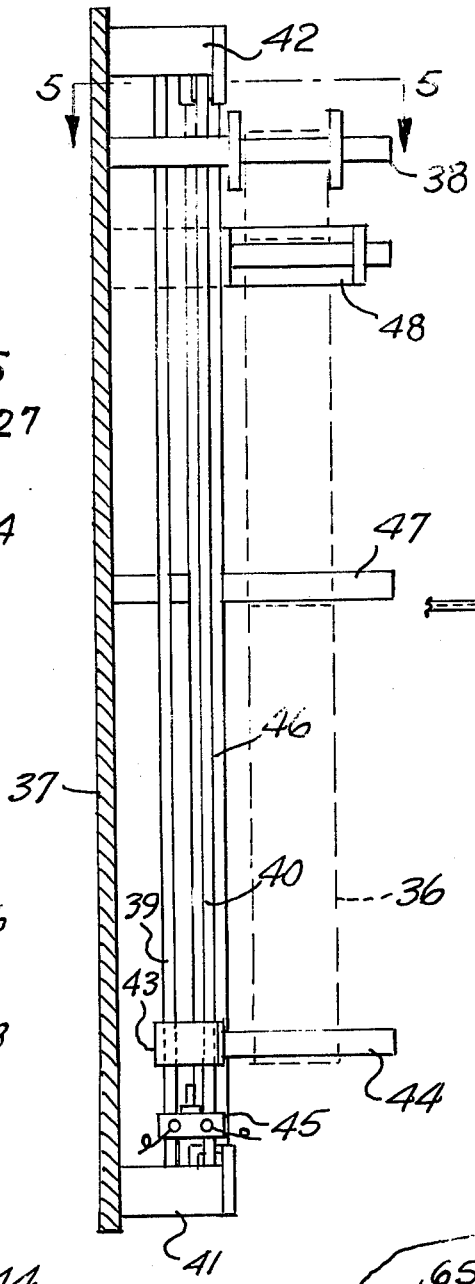
FIG. 4 is an enlarged fragmentary vertical sectional view taken on the line 4—4 of FIG. 2 looking in the direction of the arrows.
Figure 7:
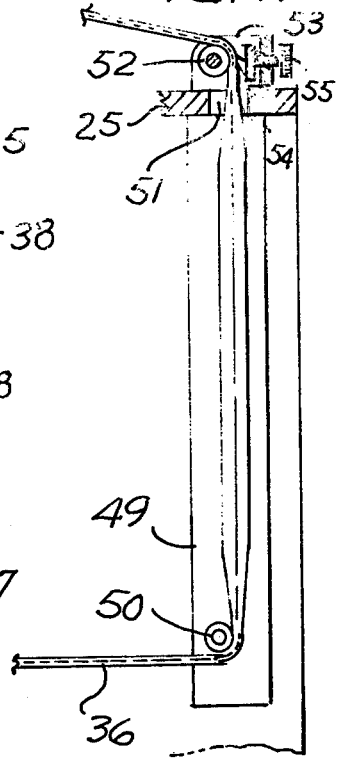
FIG. 7 is a fragmentary vertical sectional view taken on the line 7—7 of FIG. 6 looking in the direction of the arrows.
Figure 5:
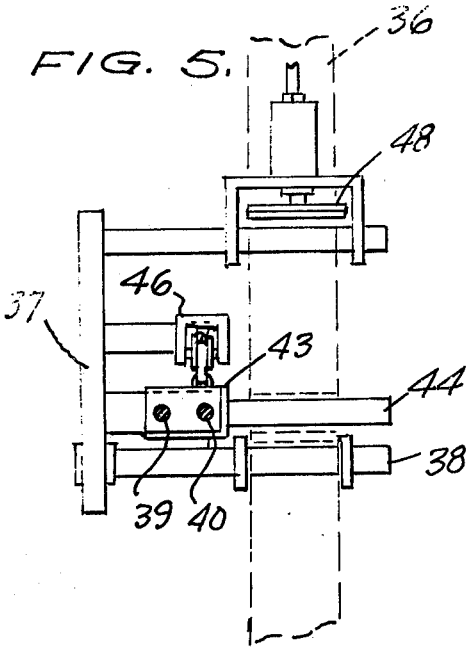
FIG. 5 is a fragmentary sectional view taken on the line 5—5 of FIG. 4 looking in the direction of the arrows.
Figure 6:
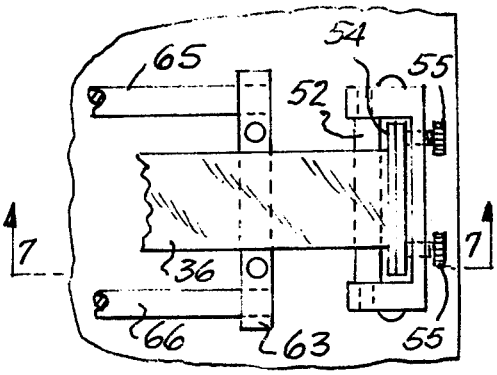
FIG. 6 is a fragmentary horizontal view taken on the line 6—6 of FIG. 2 looking in the direction of the arrows.

Referring now to the drawings in detail wherein like reference characters indicate like parts throughout the several figures the reference numeral 20 indicates generally a combined bag forming and filling apparatus.

The apparatus 20 includes a frame 21 supported on a plurality of casters 22 and having a generally horizontal base plate 23 mounted thereon. The frame 21 has a plurality of upright posts 24 extending upwardly therefrom and supporting a generally horizontal plate 25 on the upper end thereof.

A bracket 26 depends generally perpendicularly from the plate 25 and has a generally horizontal shaft 27 mounted for rotation in bearing 28 carried by the bracket 26. An electric brake 29 is mounted on the bracket 26 and is adapted to couple with a brake disk 30 secured to the shaft 27 in order to slow the turning of the shaft 27. A plexiglas disk 31 is secured to a hub 32 secured to the shaft 27 and a second plexiglas disk 33 is secured to the shaft 27 by means of a collar 34 and set screw 35. The plexiglas disks 31, 33 are spaced apart and have a roll of tubular heat sealable plastic 36 mounted therebetween.

A plate 37 is secured to the rear of the panel 25 intermediate the opposite ends thereof and extends downwardly toward the plate 23. A guide shaft 38 extends perpendicularly outwardly from the plate 37 adjacent the upper end thereof.

A pair of vertically mounted spaced parallel guide rods 39, 40 are secured at their lower ends to a block 41 mounted adjacent the lower end of the plate 37 and their upper ends are secured to a block 42 also secured to the plate 37. A carriage 43 is mounted for vertical sliding movement on the rods 39, 40 and has a guide shaft 44 secured thereto and extending parallel to the guide shaft 38. A lower limit switch 45 is mounted on the bars 39, 40 and is adapted to be actuated by downward movement of the carriage 43. An air cylinder 46 is provided for moving the carriage 43 upwardly and downwardly as described below.

A guide shaft 47 extends outwardly from the plate 37 parallel to the guide shaft 38. An air actuated brake 48 is mounted on the plate 37 as can be best seen in FIG. 1. A bracket 49 is secured to and depends from the plate 25 and has a guide shaft 50 secured thereto and extending parallel to the shaft 38. The coil 36 of tubing is trained over the guide shaft 38 under the guide shaft 44 over the brake 48 under the guide shaft 47 and then under the guide shaft 50 from which it extends upwardly through a slot 51 in the plate 25 and over a guide shaft 52 mounted on a bracket 53. A rubber wiper 54 is mounted for movement toward the shaft 52 on hand actuated screws 55.

An electric motor 56 directly drives a vacuum pump 57 which draws a vacuum through vacuum lines 58 cooperating with filters 59. An electric motor 60 is secured to the under side of the plate 25 and drives a clutch brake assembly 61 by means of a belt 62.

A rail frame 63 is secured to extend transversely to the upper side of the plate 25 adjacent the slot 51. A second rail frame 64 is secured to the upper side of the plate 25 at the opposite end of the apparatus 20 and parallel to the frame member 63. A pair of round rails 65,66 are mounted in the frame 63,64 and extend parallel to each other and in spaced above parallel relation to the plate 25. A generally rectangular support block 67 is mounted for longitudinal sliding movement on the rails 65,66 which extend through the block 67. The block 67 is slotted at 68 and is adapted to be clamped to the rail 65 by an elongate screw 69.

Figure 8:
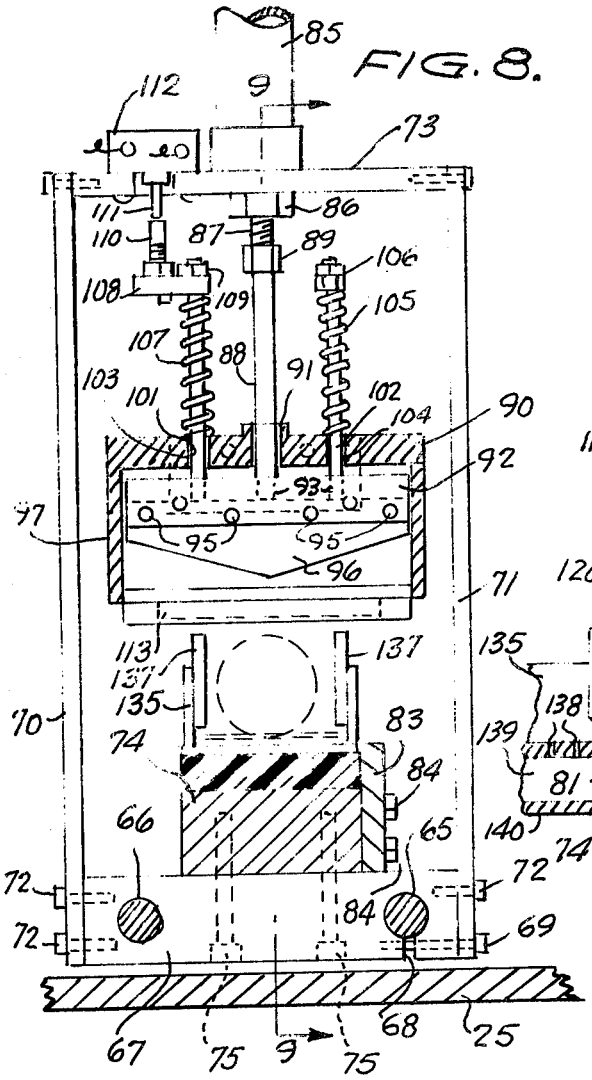
FIG. 8 is an enlarged fragmentary vertical sectional view taken on the line 8—8 of FIG. 2 looking in the direction of the arrows.
Figure 9:
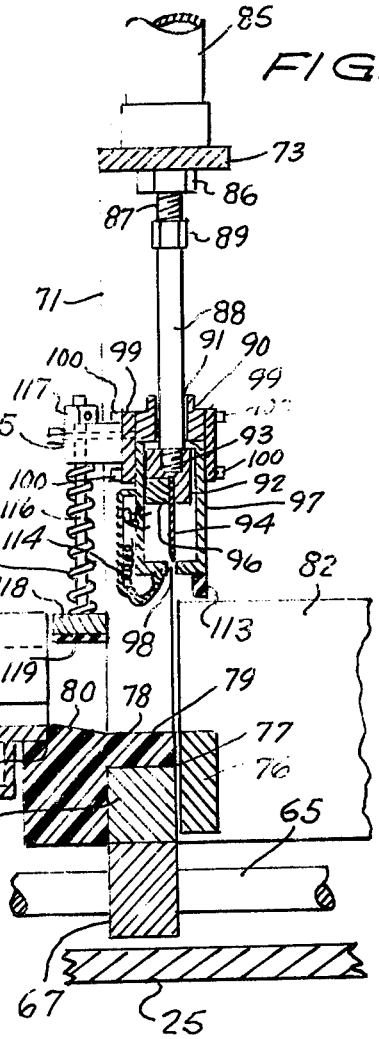
FIG. 9 is a transverse sectional view taken on the line 9—9 of FIG. 8 looking in the direction of the arrows.
Figure 10:
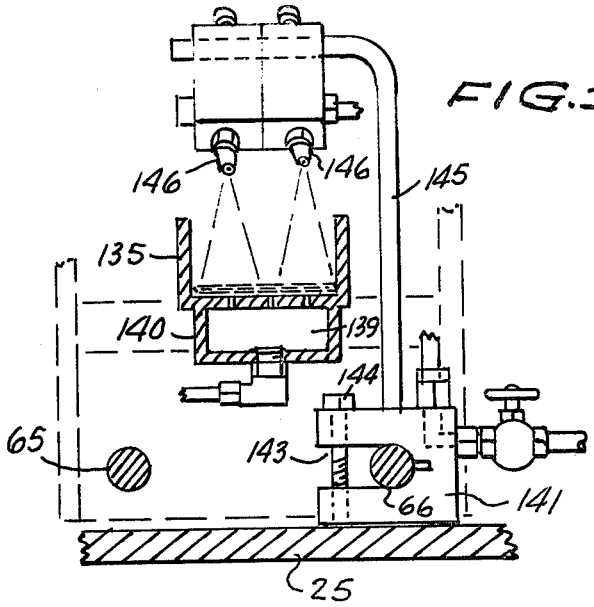
FIG. 10 is an enlarged fragmentary transverse sectional view taken on the line 10—10 of FIG. 2 looking in the direction of the arrows.
Figure 11:
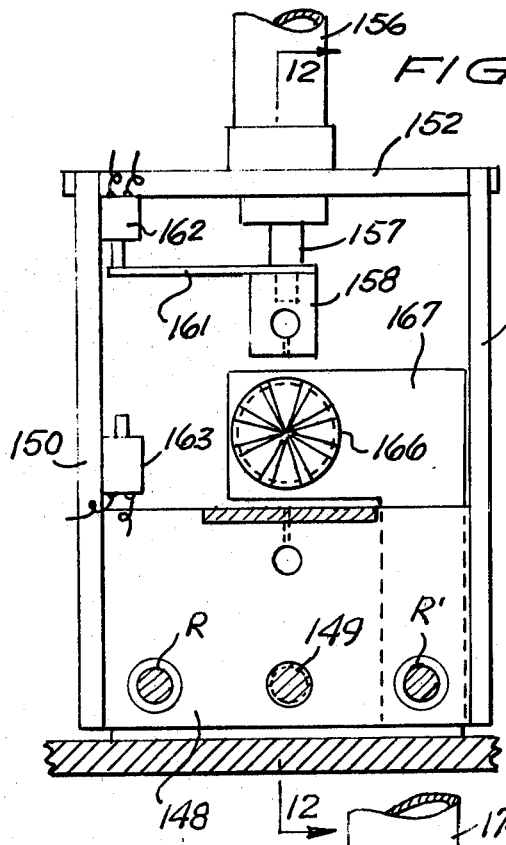
FIG. 11 is an enlarged transverse sectional view taken on the line 11—11 of FIG. 2 looking in the direction of the arrows.

A pair of upright posts 70,71 are secured to opposite ends of support block 67 and extend perpendicularly upwardly therefrom. Screws 72 secure the posts 70,71 to opposite ends of the block 67. A horizontal bar 73 extends between and is secured to the upper end of the posts 70,71 as can be best seen in FIGS. 8 and 9.

A base block 74 is secured to the block 67 by means of a pair of machine screws 75. A bar 76 is secured to the block 74 in slightly spaced relation thereto to provide a slot 77 therebetween. A teflon base member 78 is secured to the block 74 and has a generally horizontal upper surface 79 flowing into an upwardly sloping ramp 80 as can be best seen in FIG. 9. The base member 78 is rabbeted at 81 for reasons to be assigned.

A generally rectangular support panel 82 extends longitudinally of the apparatus 20 and includes a generally rectangular tongue 83 secured to the block 74 by machine screws 84.

An air cylinder 85 is mounted on the cross bar 73 by means of a nut 86 and is provided with a non-rotating threaded shaft 87 extending below and freely slidable through the nut 86. A shaft 88 extends axially of and is threaded onto the shaft 87 by means of a fitting 89. A bar 90 is provided with an oilite bearing 91 through which the shaft 88 extends for vertical sliding movement with respect to the bar 90. A knife block 92 is mounted on the threaded end 93 of the shaft 88 and has a knife clamping block 94 secured thereto by means of a plurality of screws 95. A V-shaped knife blade 96 is secured to the bar 92 by means of the clamping block 94 and the screws 95. A generally U-shaped housing 97 is provided with a slot 98 in its lower face to permit the knife blade 96 to extend therethrough. The housing 97 is secured to the cross bar 90 by means of side plates 99 and screws 100.

A pair of spaced apart parallel spring shafts 101, 102 are threaded into the cross bar 92 on opposite sides of the shaft 88 and extend upwardly through bores 103, 104 respectively into cross bar 90. A coil spring 105 is mounted on the shaft 102 engaging at its lower end against the cross bar 90 and at its upper end against adjusting nuts 106. A coil spring 107 is mounted on the shaft 103 and engages against the cross bar 90 at its lower end and against a bracket 108 secured by nut 109 at its upper end. An adjustable finger 110 extends upwardly from the bracket 109 to engage the contact 111 of a micro-switch 112 mounted on the cross bar 73.

A rubber clamping strip 113 is secured to the bottom of the housing 97 for cooperatively clamping the tubing 36 with the block 76. A heat sealer 114 is secured to the housing 97 and is adapted to engage the tubing 36 supported on the horizontal portion 79 of the teflon block 78 to seal the tubing at one end thereof.

A block 115 is secured to the plate 99 on one side of the housing 97 and has a pair of shafts 116 mounted for vertical sliding movement therein. The shafts 116 have a collar 117 on their upper end and a shoe 118 on their lower ends. A rubber cover 119 is mounted on the shoe 118 for clamping the tubing 36 against the ramp 80. A coil spring 120 on the shaft 116 normally urges the shoe 118 downwardly with respect to the block 115.

The support panel 82 is provided with a generally horizontal ejection guide block 121 at the end of the support panel 82 opposite the block 74. A flat guide plate 122 is secured to the panel 82 adjacent to but spaced from the block 121. A cover plate 123 is secured to the plate 122 in upwardly spaced relation to the central portion of the plate 122 providing a generally horizontal passageway 124 therebetween. A drive roller 125 is journalled in a bearing in the support panel 82 and is driven by a belt 126 extending from the electric clutch brake mechanism 61. An idler pulley P maintains tension on the belt 126.

An idler roller 127 is journalled in a bearing in the support panel 82 and engages the drive roller 125 so as to pinch one edge of the tubing 36 therebetween to drive the tubing 36 forwardly in the apparatus 20. The idler roller 127 is connected by a belt 128 to a pulse generator 129 supported from the posts 71.

A support plate 130 is secured to the support panel 82 and has a motor 131 mounted thereon with its shaft 132 extending to overlie the cover plate 123. A concaved drive roller 133 is mounted on the shaft 132 of the motor 131 and is adapted to engage the filled bag to assist in ejecting the bag from the apparatus 20.

A guide shaft 134 extends horizontally outwardly from the support panel 82 and is parallel to the guide shaft 52.

A channel shaped guide tray 135 engages at one end in the rabbet 81 and is secured to the block 78. The opposite end of the tray 135 is supported by a post 136 extending upwardly from the rail frame member 64. A pair of guide plates 137 extend upwardly from the tray 135 at each end thereof in opposed relation.

The bottom of the tray 135 is perforated at 138 to communicate with an air chamber 139 formed by a box 140 secured in air tight relation to the under side of the channel tray 135. The box 140 is connected to an external source of air under pressure (not shown).

A pair of clamp blocks 141, 142 are slidably mounted on the rails 66. Each of the clamp blocks 141, 142 has a slot 143 which can be adjusted by means of a bolt 144 to secure the clamp block 141 and the clamp block 142 in adjusted position along the rails 66. An inverted L-shaped post 145 extends upwardly from each of the clamp blocks 141, 142 with each having a pair of air jets 146 mounted thereon to direct a draft of air downwardly toward the tray 135.

A rail block B is secured to the plate 25 and extends parallel to the rail support block 64. A pair of spaced apart parallel rails R, R′ are supported at one end in the rail support block 64 and at the opposite end in the rail block B.

An air cylinder 147 is secured to the rail support 64 and extends longitudinally thereof.

A generally rectangular support block 148 is slidably mounted on the rails R,R′ and is secured to the piston rod 149 of the air cylinder 147. A pair of spaced parallel upright posts 150, 151 are secured to the support block 148 and are connected at their upper ends by a cross bar 152. A vacuum manifold 153 is formed in support block 148 and a plurality of bores 154 communicate through the top of the support block 148.

Figure 12:
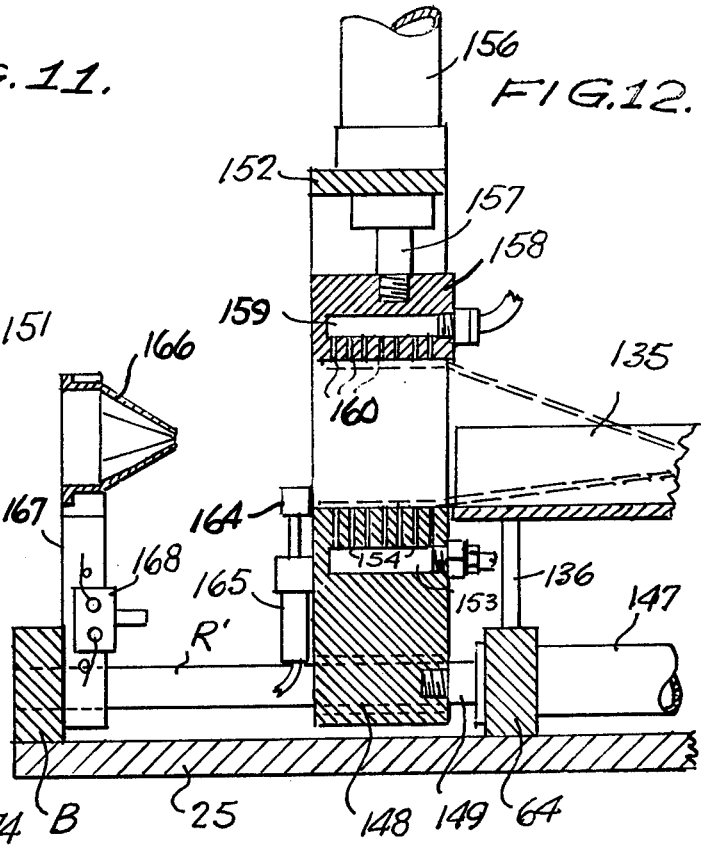
FIG. 12 is a fragmentary longitudinal sectional view taken on the line 12—12 of FIG. 11 looking in the direction of the arrows.
Figure 13:
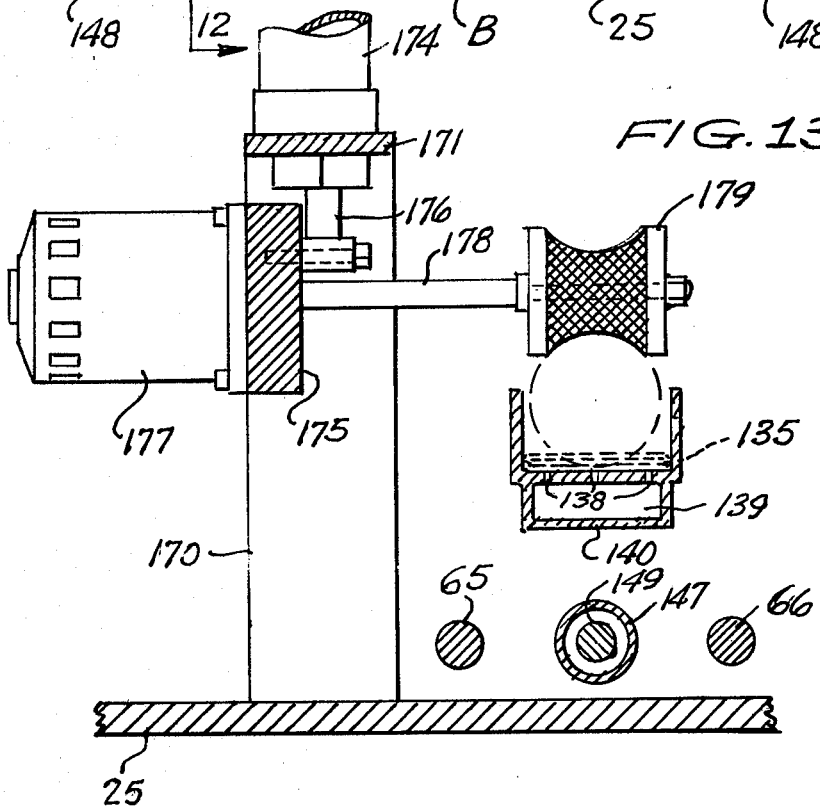
FIG. 13 is an enlarged fragmentary transverse sectional view taken on the line 13—13 of FIG. 2 looking in the direction of the arrows.

An air cylinder 156 is secured to the cross bar 152 and has a piston rod 157 depending therebelow. An upper vacuum jaw 158 is secured to the piston rod 157 and has a manifold 159 formed therein. A plurality of bores 160 extend from the manifold 159 to the lower surface of the vacuum jaw 158 as can be best seen in FIG. 12. An arm 161 is secured to the vacuum jaw 158 and extends laterally therefrom to contact an upper limit switch 162 at the upper end of the travel of the jaw 158. A lower limit switch 163 is secured to the post 150 and is contacted by the arm 161 at the lower limit of movement of the vacuum jaw 158.

A stop 164 is mounted on a small air cylinder 165 to move the stop 164 into and out of position as described below. A conical flexible finger mandrel 166 is secured to an inverted L-shaped member 167 mounted on the rail block B. The mandrel 166 is positioned in alignment with the tray 135. A limit switch 168 is positioned on the L-shaped member 167 and is adapted to be contacted by the support block 148.

A pair of spaced parallel upright posts 169, 170 are secured at the lower end to the plate 25 and are connected at their upper ends by a cross bar 171. The cross bar 171 is secured by a pair of bolts 172 at each end thereof extending through vertical slots 173 in the posts 169, 170 to thus permit the cross bar 171 to be vertically adjusted. An air cylinder 174 is mounted on the cross bar 171 and a motor bracket 175 is secured to the piston rod 176 of the air cylinder 174. An electric motor 177 is secured to the motor bracket 175 and has an elongate motor shaft 178 extending outwardly therefrom. A concaved rubber covered roller 179 is secured to the shaft 178 to overlie the tray 135.

A control unit 180 shown phantom lines in FIG. 1 may be provided for controlling the sequential operation of the apparatus 20 as required.

USE AND OPERATION OF THE INVENTION

In the use and operation of the apparatus 20 a coil of tubular heat sealable polyethylene plastic is mounted on the shaft 27 and is trained over the guide shaft 38 under the guide shaft 44 over the brake mechanism 48 under the guide shaft 47 under the guide shaft 50 upwardly through the slot 51 in the plate 25 and through the wiper assembly 53 over the guide shaft 52.

An air bubble is inserted in the tubing 36 just beneath the wiper assembly 53 by means of a hypodermic needle and the air bubble is trapped by the wiper assembly 53 so that it continuously opens the tubing 36 separating the adherence of the tube 36 to its self. As the tubing 36 is moved through the wiper 53 by the apparatus above the plate 25 the brake 48 is released and the loop of tubing depending from the brake 48 is drawn upwardly until a sufficient length of tubing has been drawn off. The brake 48 is then applied and the carriage 43 with guide shaft 44 is moved downwardly by the air cylinder 46 and cable drive connected thereto. A limit switch 45 is engaged by the carriage 43 at its lower most point to reverse the carriage 43 so that it will move back to the upper most position. As the carriage 43 is moving downwardly the brake 29 is released to permit the shaft 27 to turn freely and as soon as the carriage 43 contacts the limit switch 45 the brake 29 is reapplied to prevent over run of the shaft 27.

The tube 36 is fed from the wiper assembly 53 across the flat guide plate 122 and under the cover plate 123. The tubing 36 is engaged along one edge by the drive roller 125 and the idler roll 127 with the idler roll driving a pulse tach 129 through a belt 128. The pulse tach 129 is used for determining the rotation of the idler roll 127 and hence the length of the tubing passing thereunder. The tubing feeds from the drive roller 125 into the tray 135 and engages the stop 164 at which point the drive roller 125 is stopped. The air cylinder 85 is then actuated moving the knife blade 96 downwardly along with the housing 97 until the rubber strip 113 engages and clamps the tubing 36 against the block 76. The knife 96 continues downwardly severing the dtubing and engaging in the slot 77. The heat sealer 114 engages the severed portion of the tubing 36 to seal it across one end. The shoe 118 is pressed downwardly against the tubing 36 holding it on the ramp 80 so that as the heat sealer 114 begins to rise the shoe 118 will prevent the tubing 36 from being pulled upwardly with the heat sealer 114. The vacuum jaw 158 is moved downwardly by the air cylinder 156 and the tubing 36 is pulled against the block 148 and against the vacuum jaw 158 by vacuum in the manifolds 153,159 and the air cylinder 156 then moves the vacuum jaw 158 upwardly to open the end of the tubing 136. The air cylinder 147 is then actuated to move the support block 148 to the left as viewed in FIG. 12 until the open end of the tubing 36 is engaged around the flexible finger mandrel 166 and the limit switch 168 is actuated.

Elongate merchandise (not shown) is then inserted through the mandrel 166 into the tubing 36 by any means (not shown). The air cylinder 174 is then actuated to bring the drive roller 179 into contact with the filled bag 36 throwing the bag 36 rearwardly along the tray 135 where it passes over the top of the cover plate 123 and is engaged by the drive roller 133 which completes the movement of the filled bag out of the apparatus 20.

The function of the air jets 146 is to maintain the tubing 36 in contact with the tray 135 as the tubing 36 moves toward the mandrel 166. Air from the chamber 139 passing upwardly through the openings 138 will support the tubing 36 when needed for long lengths of the tubing 36. The tray 135 can be replaced with trays of varying lengths to provide for constructing bags of the desired length for the product. The support block 67 can be adjusted along the rails 65,66 so as to be adapted to the length of the tray 135.

Having thus described the preferred embodiment of the invention it should be understood that numerous structural modifications and adaptations may be resorted to without departing from the spirit of the invention.

What is claimed is:

1. A bag forming and filling apparatus comprising a frame, a roll of heat sealable plastic tubing supported in said frame, means on said frame for moving said tubing in one direction with respect to said frame, means engageable with said tubing for simultaneously cutting said tubing into bag lengths and heat sealing one end of said bag length, means on said frame for opening one end of said bag length, a stationary mandrel on said frame, and means for moving said opened end of said bag length substantially horizontally in said direction onto said mandrel to permit elongate merchandise to be inserted through said mandrel into said bag length, means on said frame engageable with said filled bag length to move said bag length in the opposite direction off of said mandrel and out of said frame.

2. A device as claimed in claim 1 wherein a tray extends across said frame between the means for cutting and sealing and the means for opening with said tray supporting said bag length for movement across said frame.

3. A device as claimed in claim 1 wherein the means for opening said bag length comprises a pair of relatively moveable vacuum jaws.

4. A device as claimed in claim 1 including means on said frame for maintaining an air bubble within said tube for separating said tube.

5. A device as claimed in claim 1 wherein the means for cutting and heat sealing includes means for stripping the tubing from the heat sealing means upon completion of the heat sealing.

6. A device as claimed in claim 1 wherein the cutting means includes a V-shaped knife and a support block for the tubing having a slot to receive said V-shaped knife as it severs the tubing.

* * * * *